US012654755B2

(12) United States Patent
Masso et al.

(10) Patent No.: US 12,654,755 B2
(45) Date of Patent: Jun. 16, 2026

(54) SYSTEM AND METHOD FOR WAGON SWING DETECTION

(71) Applicant: Rumo Malha Sul S.A., Curitiba (BR)

(72) Inventors: Caroline Martins Masso, Curitiba (BR); Marcos Luis Pedroso, Apucarana (BR)

(73) Assignee: RUMO S.A., Curitiba (BR)

( * ) Notice: Subject to any disclaimer, the term of this patent is extended or adjusted under 35 U.S.C. 154(b) by 248 days.

(21) Appl. No.: 18/385,317

(22) Filed: Oct. 30, 2023

(65) Prior Publication Data

US 2024/0140506 A1 May 2, 2024

(30) Foreign Application Priority Data

Oct. 31, 2022 (BR) ..... 102022022169-3

(51) Int. Cl.
*B61L 27/57* (2022.01)

(52) U.S. Cl.
CPC ..... *B61L 27/57* (2022.01)

(58) Field of Classification Search
CPC ..... B61L 27/57
USPC ..... 701/19
See application file for complete search history.

(56) References Cited

U.S. PATENT DOCUMENTS

| | | | | |
|---|---|---|---|---|
| 5,368,260 | A | 11/1994 | Izbinsky et al. | |
| 2006/0010971 | A1 | 1/2006 | Kilian et al. | |
| 2020/0047779 | A1 * | 2/2020 | Taketo | G01B 9/02024 |

FOREIGN PATENT DOCUMENTS

| | | |
|---|---|---|
| BR | PI 0513289-4 B1 | 7/2005 |

* cited by examiner

*Primary Examiner* — Lindsay M Low
*Assistant Examiner* — Omar Morales
(74) *Attorney, Agent, or Firm* — Lippes Mathias LLP

(57) ABSTRACT

A system (1) and method for the detection of wagon swing (6) are provided. Wagon swing is detected by specific sensors (5*a*, 5*b*, 5*c*, 5*d*) when a wagon (6) presents excessive swing when passing through a certain section of a railway track (2), in which such detection is made by measuring specific distances, advantageously disregarding an angle of attack of the wagon wheels (6) measured between an axis of such wheels and a horizontal plane on which railway tracks (2) are located.

24 Claims, 10 Drawing Sheets

SYSTEM AND METHOD FOR WAGON SWING DETECTION

The present invention relates to a system and method for the detection of wagon swing, through which it is detected by means of specific sensors when a wagon presents excessive swing when passing through a certain section of a railway track.

DESCRIPTION OF THE STATE OF THE ART

When it comes to railways and their compositions (trains), it is extremely necessary to monitor parameters to ensure safe circulation, whether for passengers or various types of loads.

There are numerous parameters that can be monitored, but in the present context, special emphasis is placed on those that may cause instability in the wagons of a composition.

Among the known solutions, there is for example the one described in document P10513289-4. This is configured to detect an angle of attack formed between the wheels of an axle and the tracks.

Therefore, the angle measured by the solution of this document is, in fact, a yaw angle between the plane of the wheel engaged on the track and a plane tangent to the track.

U.S. Pat. No. 5,368,260, on the other hand, discloses laser or infrared sensors that measure oscillations and angles in a moving car also configured to measure an angle of attack between the plane of a wheel and the tangent to the external track to which the wheel is engaged.

Other solutions propose measuring oscillations in a wagon with sensors installed directly on the wagon, that is, solutions embedded in it.

However, it should be noted that the angle of attack may not reflect the swing of the wagon. More specifically, it is observed that the angle formed between a wheel axis and the tangent plane to the track does not necessarily reproduce the wagon's rocking inclination angle in a scenario of wagon instability and, if it occurs, this is a mere coincidence.

This is mainly because a damping system operates which aims, among other functions, not to transmit any oscillations, vibrations or swings suffered by its base (axles, wheels, etc.) to the wagon.

As a result, the solutions known in the prior art do not adequately apply to monitoring the wagon's swing. If applied for this purpose, the measured data will be inaccurate and will not reflect the real nature of the wagon's swing.

Therefore, there are no solutions in the state of the art capable of correctly gauging, monitoring, measuring and/or observing a swing in the wagon and transmitting information so that appropriate measures can be taken, especially with regard to maintenance of such wagons.

Objectives of the Invention

An objective of the present invention is to provide a system and method for the detection of wagon swing.

An objective of the present invention is to provide a system and method for the detection of wagon swing that acts through a set of sensors.

An objective of the present invention is to provide a system and method for the detection of wagon swing that verifies the status of a wagon damping assembly.

An objective of the present invention is to provide a system and method for the detection of wagon swing that allows selective maintenance to be carried out on the wagon damping assembly.

An objective of the present invention is to provide a swing measuring station comprising a set of sensors and compatible with the system and method also objects of the present invention.

BRIEF DESCRIPTION OF THE INVENTION

The objectives of the present invention are achieved by means of a wagon swing detection system comprising a set of fixed sensors, spaced apart, arranged at a certain height from the ground and installed on a section of a railway track, the system being configured to obtain at least one angle of inclination of a car in relation to its center line.

The objectives of the present invention are also achieved through a wagon swing detection method implemented through a set of fixed sensors, spaced apart, arranged at a height from the ground and installed in a section of a railway track, the method being compatible with the system also object of the present invention.

The objectives of the present invention are also achieved by means of a swing measuring station comprising a set of fixed sensors, spaced apart, arranged at a height from the ground and installed on a section of a railway track, the measurement station swing measurement being compatible with the system and method also objects of the present invention.

BRIEF DESCRIPTION OF THE DRAWINGS

The present invention will now be described in more detail based on an example of execution represented in the drawings. The figures show.

DETAILED DESCRIPTION OF FIGURES

Figure 1:
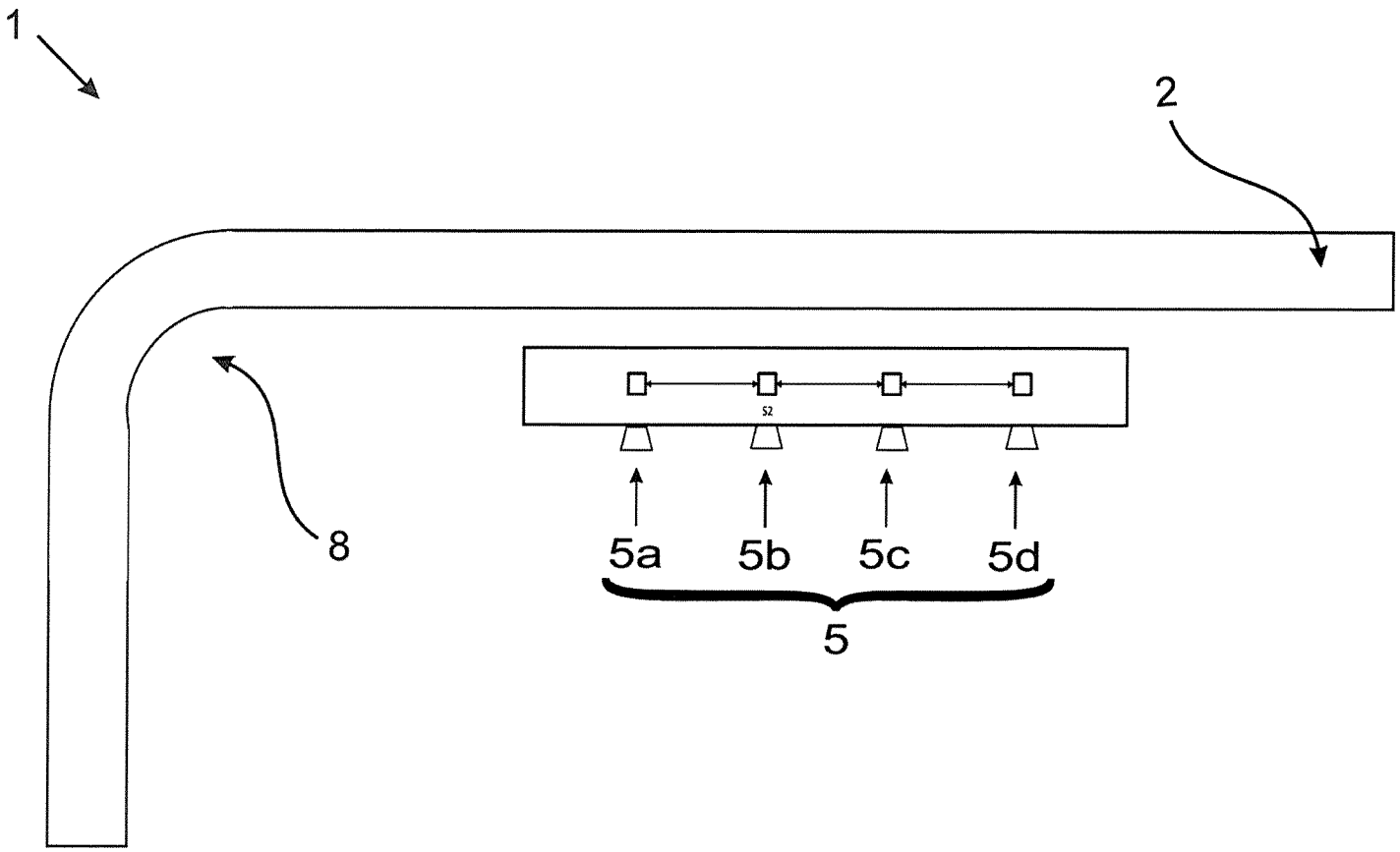
FIG. 1—is a representation of a section of railway equipped with a system, method and station, objects of the present invention.

Firstly, with initial reference to FIGS. 1 to 10, the present invention refers to a wagon swing detection system 1, now also referred to as system 1. System 1 as detailed below aims to especially allow detecting swing of a wagon 6 that passes through a certain section of a railway track 2.

In the context of the present invention, said swing can be understood as a movement or mostly angular oscillation of the wagon 6 that can be caused by several factors, among which irregularities on the railway tracks 2, curves made with excessive speed and load unbalance, for example. Swings are exemplified in FIGS. 9 and 10, in which a left side of the car 6 is observed compressing and a right side of the car 6 stretching.

Thus, wagon 6 suffers a lateral force when passing through a point on the railway track that produces this oscillation 8 (for example, curve, unevenness, track changing devices, among others) which, due to its positioning on the tracks, causes it to be pushed laterally and describe an angular movement around a contact point on said track.

In relation to the swing that the present invention monitors, it is necessary to define some parameters such as amplitude, frequency, damping factor and maintenance history.

Amplitude z reflects how much the car 6 moves from one side to the other in relation to its center line.

Frequency w comprises a number of amplitude cycles that occur in a given space of time.

In turn, damping factor $\zeta$ represents how much a damping assembly 7 of wagon 6 can retain from this swing so that wagon 6 remains stable.

Maintenance history is a systematic representation that indicates whether or not wagon 6 has undergone maintenance that may or may not have treated the damping assembly 7.

Other important variables considered in the present invention are natural oscillation frequency wn, initial speed v0 and initial amplitude z0.

For a car 6, mathematically we have equation 1 below which relates these variables as follows:

$$z(t) = e^{-\zeta\omega_n t}\left[z_o \cos\ wt + \frac{\zeta w_n z_o + v_o}{w} sen\ wt\right]$$

in which the decreasing exponential function causes the harmonic function to gradually dampen as a function of the damping factor $\zeta$.

Just to give a numerical example, if the damping assembly 7 is in "new" condition, the damping factor $\zeta$ is 0.25. As it degrades, this value is reduced and can reach 0.19. In this case, there is less attenuation of the swing, in accordance with the previous equation.

Thus, the decreasing exponential function causes the harmonic function of equation 1 to gradually dampen as a function of the damping factor $\zeta$. When the vibration amplitude z(t) decreases with time, the system is said to be stable.

Based on equation 1, it is possible to classify the swing of wagon 6. At this point, it is clear that the swing of wagon 6 can be classified as overdamped, critically damped or underdamped. This damping classification, however, will not be detailed in this text as it is already widespread knowledge in this field.

In any case, wagon 6 tends to recover due to the damping assembly 7 acting on it, where this recovery occurs due to the damping factor $\zeta$ mentioned above.

To monitor this swing in light of the previously described variables, the system 1 then comprises a set of sensors 5 configured specifically for this purpose. Merely to exemplify a configuration of the present invention, sensors 5*a*, 5*b*, 5*c*, 5*d* that make up the set of sensors 5 can be of the infrared type.

These sensors act satisfactorily by emitting waves that allow the necessary data to be measured with adequate precision to achieve the objectives of the present invention, which will be detailed below.

Figure 8:
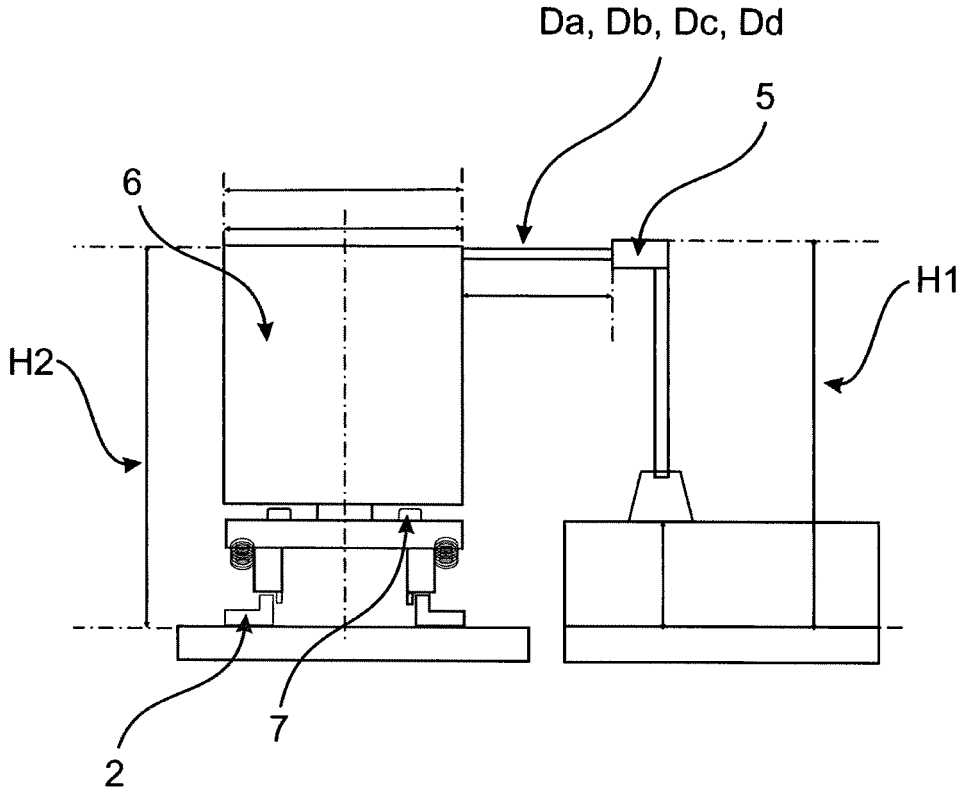
FIG. 8—is a view exemplifying a swing measuring station in accordance with the teachings of the present invention.

As shown in FIG. 8, such sensors are fixed in relation to the wagon 6, spaced apart, arranged at a certain height H1 of the sensor in relation to the ground and installed on a section of a railway track 2.

It should be noted that the number of sensors in the sensor set 5 is not a limitation of the present invention. However, the number of four sensors 5*a*, 5*b*, 5*c*, 5*d* proves to be advantageous, as it allows you to obtain a satisfactory amount of data from wagon 6 while maintaining a low installation and subsequent maintenance cost.

For this reason, a set of sensors 5 formed by four sensors 5*a*, 5*b*, 5*c*, 5*d* will be considered the preferred configuration of the present invention, this not being a limiting quantity thereof.

More specifically in relation to the operation of the set of sensors 5, each sensor 5*a*, 5*b*, 5*c*, 5*d* of the set of sensors 5 is configured to measure a respective distance Da, Db, Dc, Dd in relation to the wagon 6 so that each distance is measured sequentially and configured as a reference parameter for the subsequent distance.

In other words, sensor 5*a* measures a distance Da, sensor 5*b* measures a distance Db, sensor 5*c* measures a distance Dc and sensor 5*d* measures a distance Dd, sequentially, that is, each of the said Sensors 5*a*, 5*b*, 5*c*, 5*d* are configured to perform their measurement after a measurement of the immediately previous sensor.

In addition, each distance Da, Db, Dc, Dd measured is taken as a reference for the immediately previous distance, that is, the distance Da is a reference for the distance Db, the distance Db is a reference for the distance Dc and the distance Dc is a reference for the distance Dd.

In this way, it is possible to compare each measured distance with the respective immediately previous distance, allowing to check whether quantities related to the swing, such as amplitude and frequency for example, are increasing or decreasing and also classify the swing.

Figure 2:
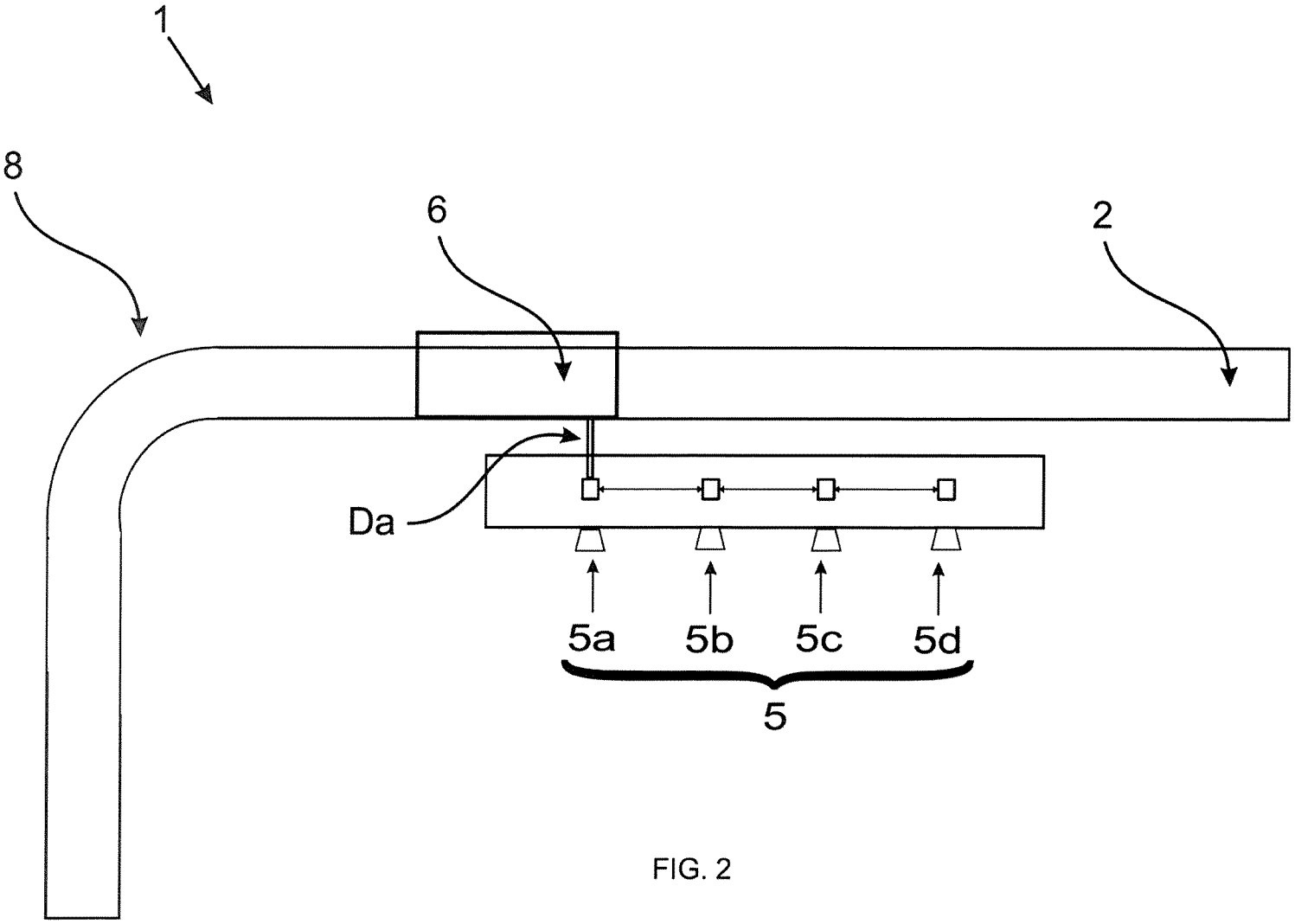
FIG. 2—represents a moving wagon passing through a section of railway track equipped with the system, method and station, objects of the present invention.
Figure 3:
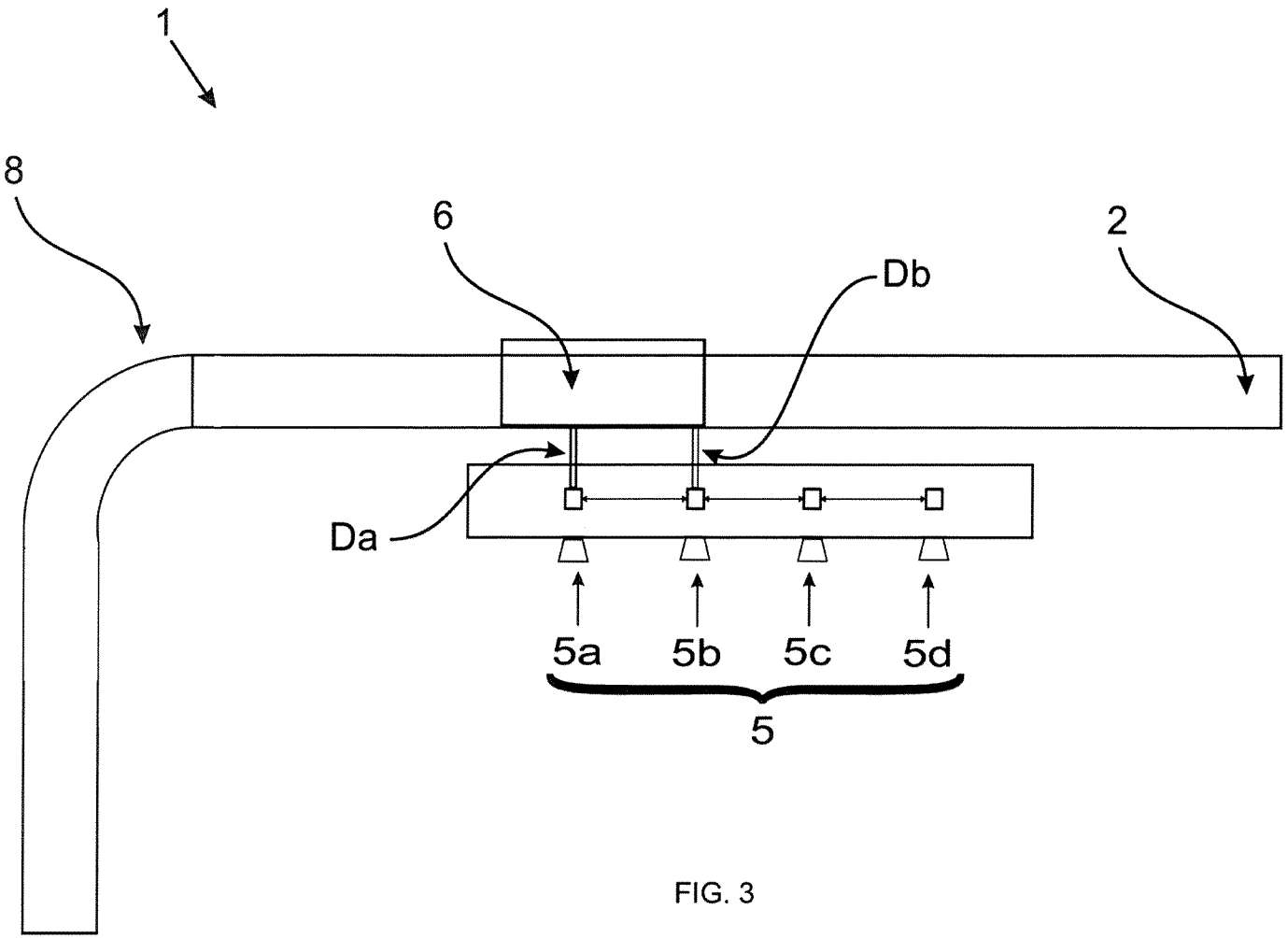
FIG. 3—represents a moving wagon passing through a section of railway track equipped with the system, method and station, objects of the present invention.
Figure 4:
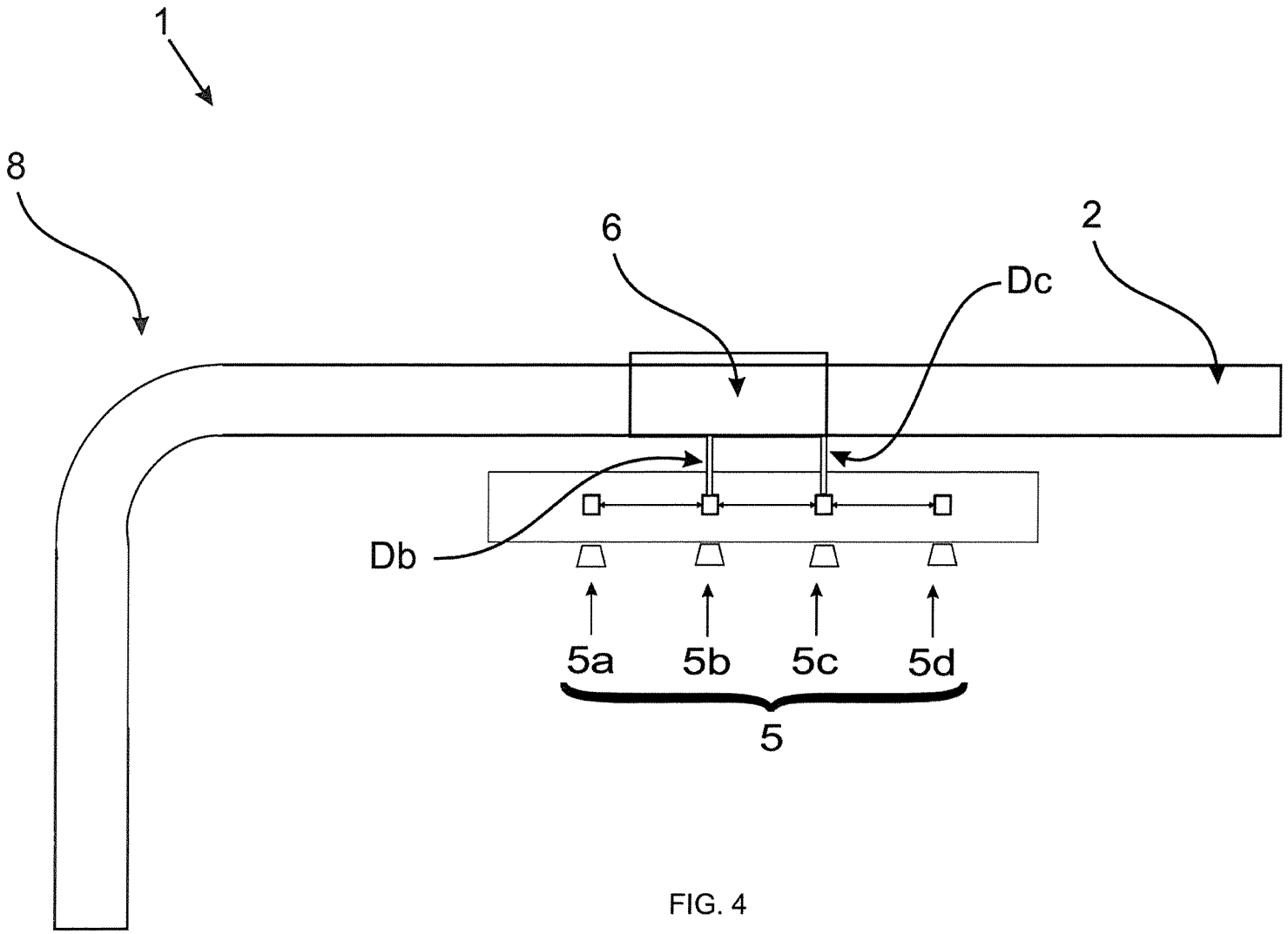
FIG. 4—represents a moving wagon passing through a section of railway equipped with the system, method and station, objects of the present invention.
Figure 5:
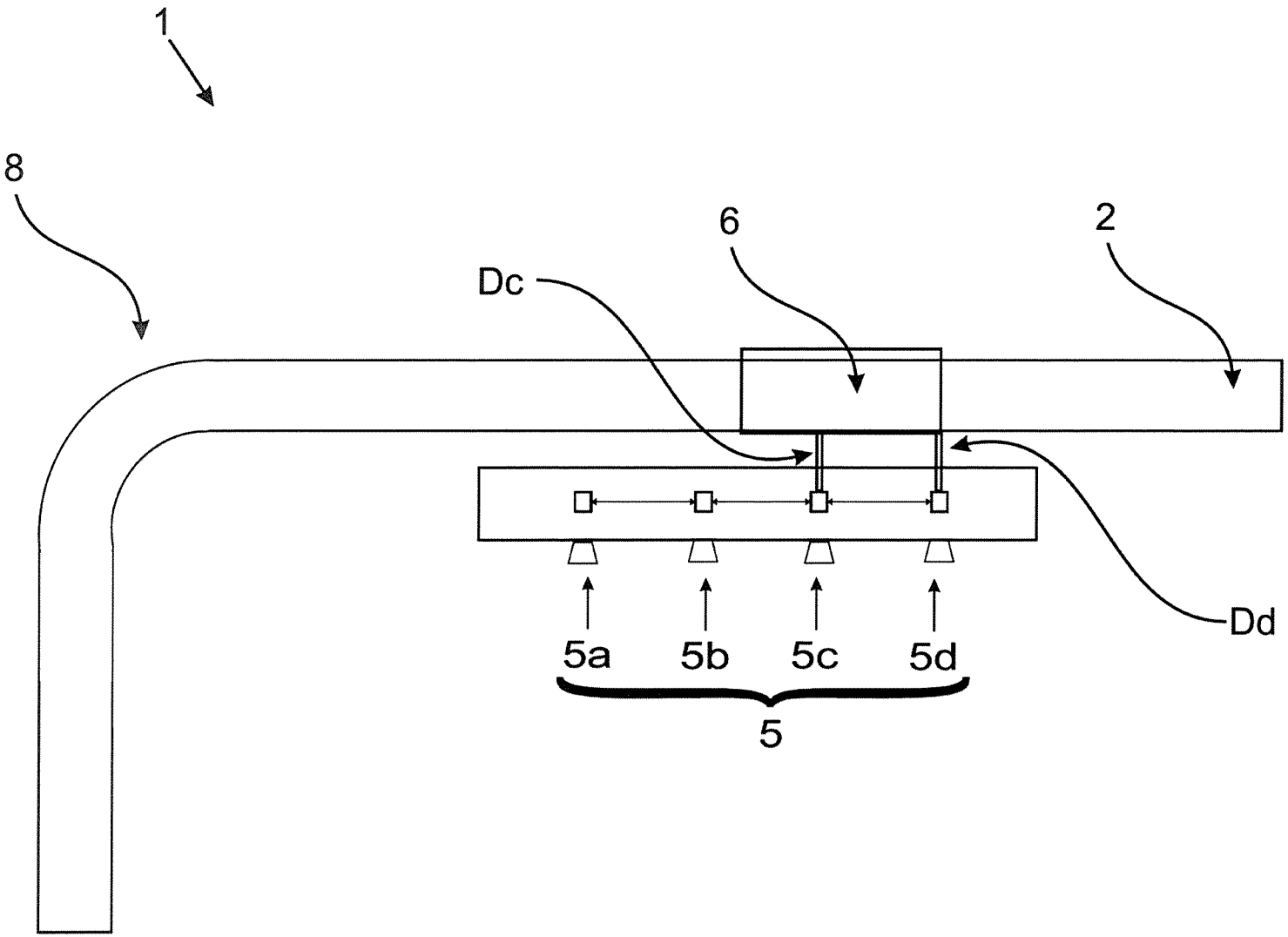
FIG. 5—represents a moving wagon passing through a section of railway track equipped with the system, method and station, objects of the present invention.
Figure 6:
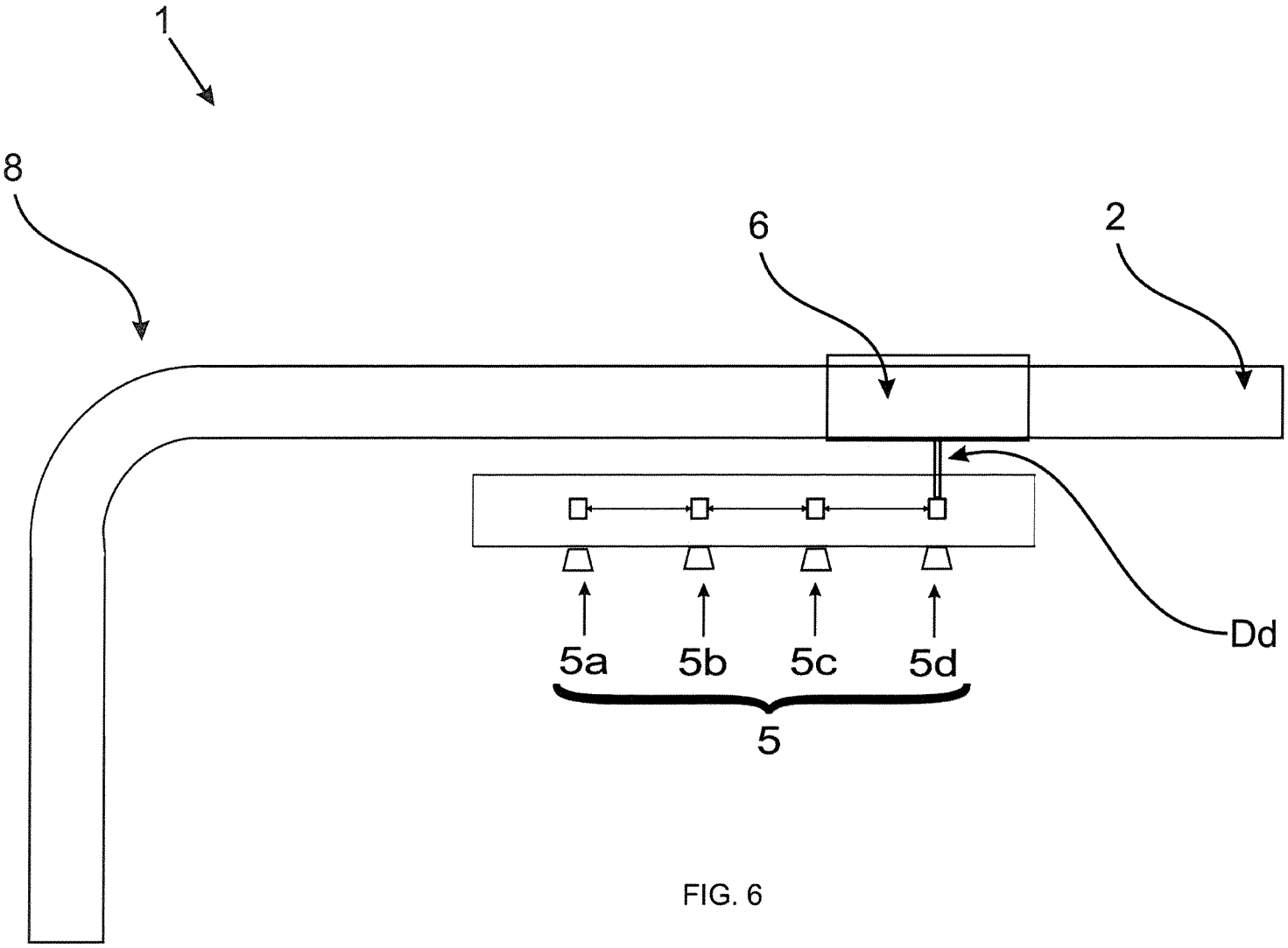
FIG. 6—represents a moving wagon passing through a section of railway track equipped with the system, method and station, objects of the present invention.

FIGS. 2, 3, 4, 5 and 6 schematically exemplify wagon 6 being sequentially monitored by sensors 5*a*, 5*b*, 5*c*, 5*d*, which also sequentially obtain the distances Da, Db, Dc, Dd also illustrated in these figures. More specifically, FIGS. 2 to 6 exemplify in sequence a moving wagon being monitored by sensors 5*a*, 5*b*, 5*c*, 5*d* to obtain respective distances Da, Db, Dc, Dd as follows:

Sensor 5*a*—Distance From (FIG. 2);
Sensors 5*a* and 5*b*—Distances Da and Db (FIG. 3);
Sensors 5*b* and 5*c*—Distances Db and Dc (FIG. 4);
Sensors 5*c* and 5*d*—Distances Dc and Dd (FIG. 5);
Sensor 5*d*—Distance Dd (FIG. 6).

Additionally, the proposed system 1 is configured so that each distance Da, Db, Dc, Dd also allows at least one real damping curve related to the swing of the wagon 6 to be obtained.

Figure 9:
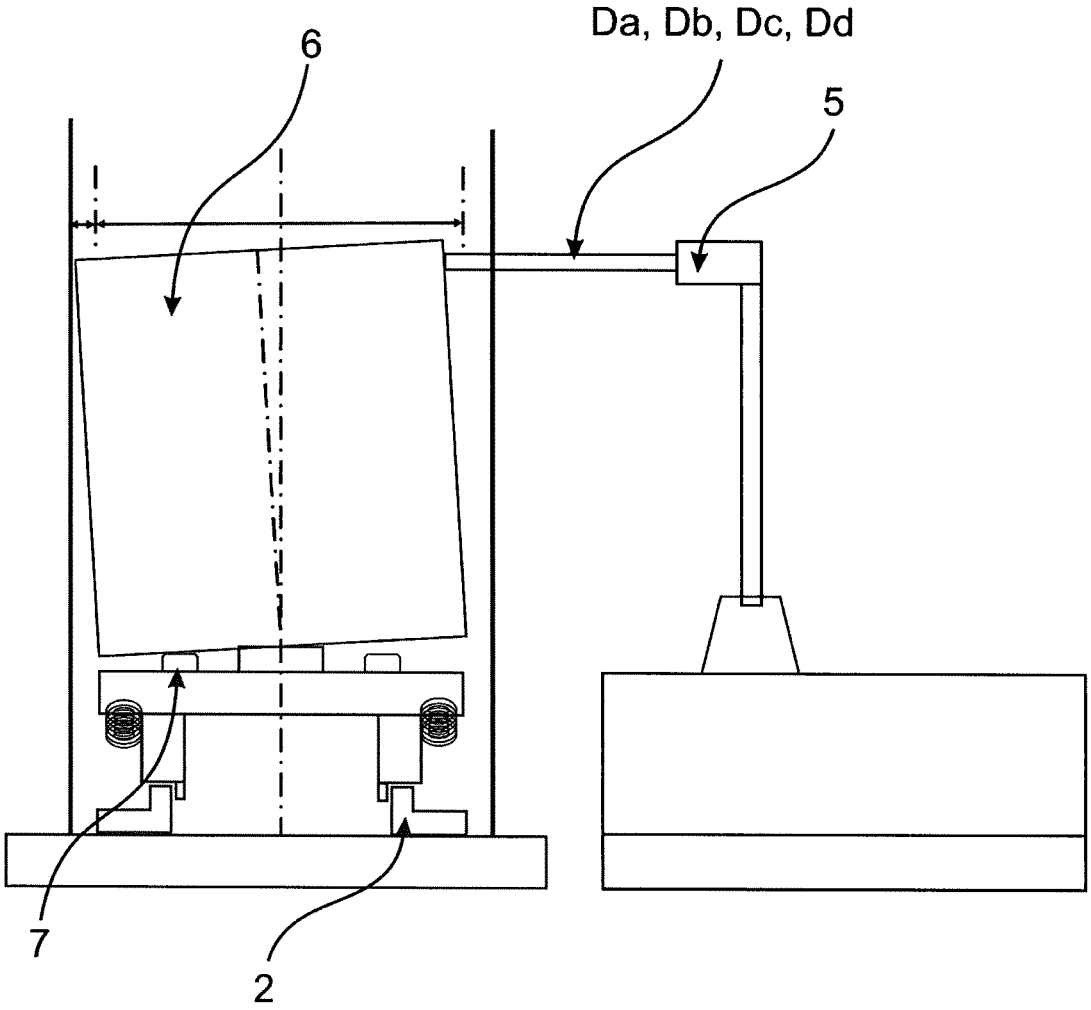
FIG. 9—is an example of a wagon tilting to the left and being monitored by the system, method and station, objects of the present invention.
Figure 10:
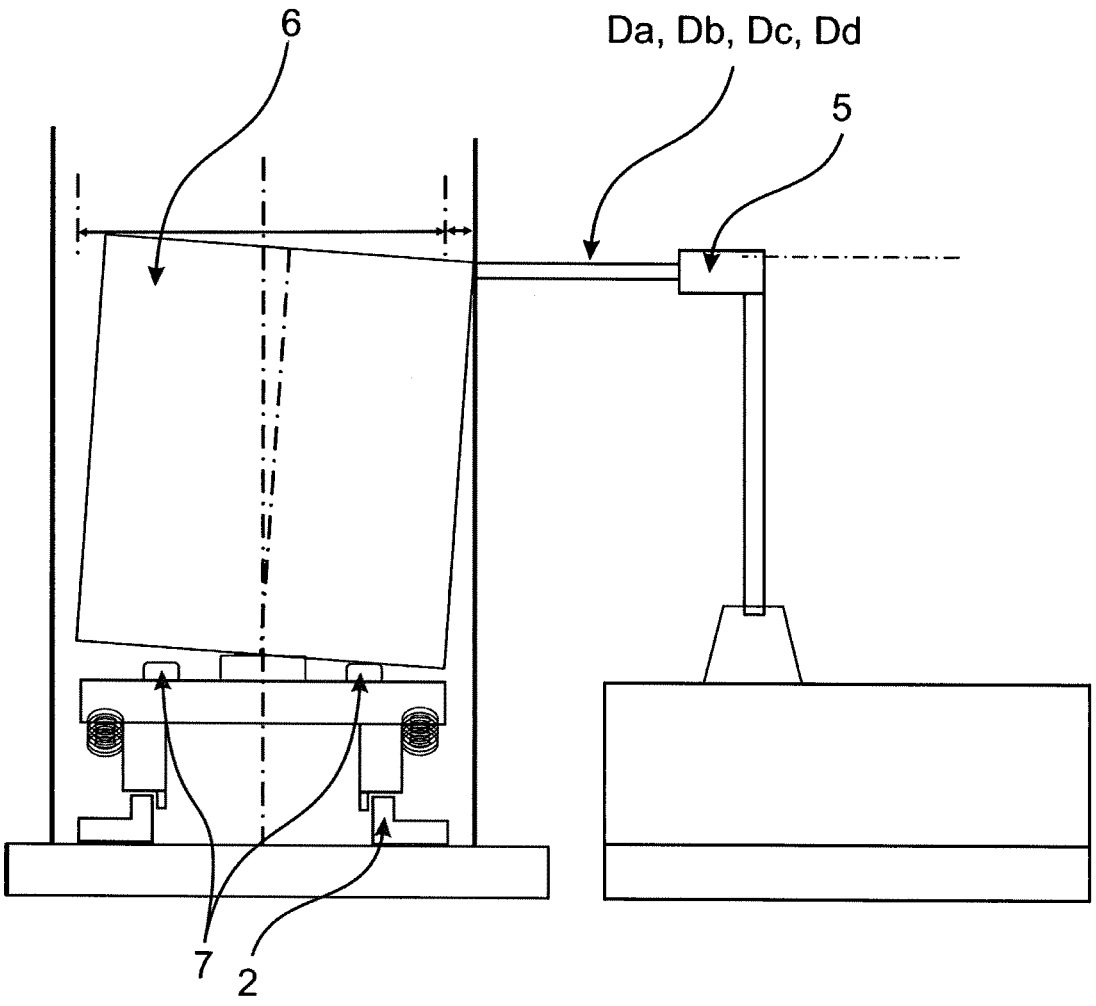
FIG. 10—is an example of a wagon tilting to the right and being monitored by the system, method and station, objects of the present invention.

As indicated in FIGS. 9 and 10, the present invention is configured to perform the swing check of the wagon 6 disregarding an angle of attack of wheels of the wagon 6 measured between an axis of such wheels and a horizontal plane in which railway tracks are found as is commonly found in the prior art.

Thus, as already mentioned, the measurement of this information related to the aforementioned quantities allows obtaining a real damping curve related to the swing of wagon 6 through the system 1 now proposed, in which the real damping curve related to the swing of wagon 6 can be completely obtained after wagon 6 passes the last sensor of the set of sensors 5, in which the real damping curve makes it possible to verify at least frequency, amplitude and damping coefficient related to the swing of wagon 6.

Figure 7:
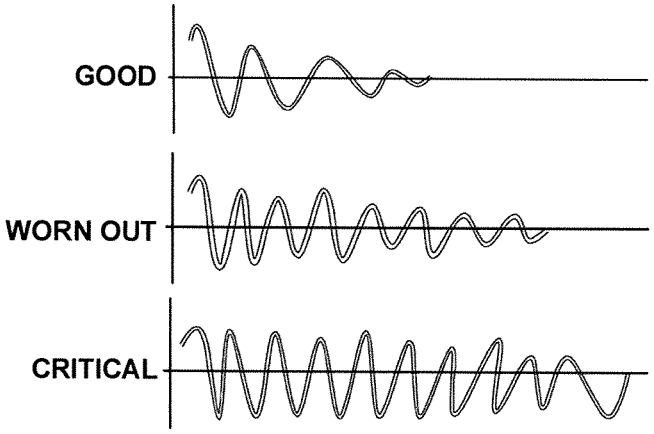
FIG. 7—are graphs exemplifying damping curves for damping sets characterized as good, worn or critical in accordance with the teachings of the present invention.

The actual damping curve can then be compared with a theoretical damping curve, previously obtained and parameterized and configured to serve as a reference for said characterization of the wagon swing and subsequent characterization of the integrity of a damping assembly 7 as per will be detailed below in light especially of FIG. 7.

Thus, based on this information, it is possible to characterize conditions of a damping assembly 7 with regard to its integrity (condition). In this sense, the damping assembly 7 can be characterized as at least good, normal or bad.

For this characterization, first a verification of rules is carried out considering absolute values derived from a theoretical formulation of the dynamic behavior of the wagons' swing. There are safety limits for the amplitude, damping and frequency of movement that allow this classification to be made.

At a second level, a check is carried out using classification rules based on the statistical data of the wagons. The more discrepant the result of the wagon under analysis from the average for that type of wagon, the more likely it is to have an item out of specification. In this case, inferences and validations are made of the statistical behavior of amplitude, damping coefficient and oscillation frequency to carry out hypothesis tests to identify wagons with anomalous behavior in their class.

In other words, the data obtained when wagon 6 passes are used to draw a real curve of the same, which is subsequently compared with theoretical curves resulting in a classification of the damping set of said wagon 6. These in-training can be used to analyze its maintenance.

It should be noted that, to this end, it is also possible to use artificial intelligence to carry out the classification using supervised and unsupervised machine learning models, seeking to identify combinations of factors that may indicate a risk to the operation.

In this aspect, system 1, object of the present invention, allows classifying the integrity of the damping assembly 7 by obtaining specific data. Obviously these classifications of good, normal or bad should not be understood in themselves as limitations to the present invention, as other classifications can also be implemented through the teachings described herein.

In one embodiment, the proposed system 1 is configured to be able to act on a wagon 6 that has at least one flat side face.

The application of system 1 in flat-faced wagons 6 proves to be quite advantageous, as this type of wagon 6 allows each sensor in the sensor set 5 to act correctly and carry out its measurements in a correct manner. Therefore, a flat face does not tend to induce erroneous measurements by the sensors precisely because it is flat.

Alternatively, the present invention may be implemented on other types of wagons with non-flat faces.

In any case, the wagon swing detection system 1, object of the present invention, is mounted in a region of the railway track away from the tracks, as illustrated in FIG. 8 in particular. An example of this type of installation can be understood as being made on a platform, station or stop, for example. In general, the assembly (installation) can be carried out on any operational section of the track that is in a swing production environment, such as the tangent of a curve that characterizes a point on the railway that produces oscillation 8.

Again, FIG. 8 also exemplifies a configuration of the system, object of the present invention, in which there is a compatibility between the height H1 of the sensor in relation to the ground and a wagon height H2. In the context of the present invention, such compatibility does not mean that the heights H1 and H2 are the same, but rather that each sensor in the sensor set 5 is positioned at a height that allows it to measure the magnitudes of each wagon 6 in a satisfactory manner, i.e. is, less than the height H1 is less than the height H2 of the wagon.

By way of example and not limitation, the height H2 of the wagon may be 3680 mm from the ground and the height of the sensor may be 3530 mm from the ground.

The assembly of system 1 should preferably be done immediately after a section where rocking is produced, such as after a curve, thus composing a rocking measurement station.

An assembly of this nature allows sensors 5*a*, 5*b*, 5*c*, 5*d* of the sensor set 5 to adjust the respective distances Da, Db, Dc, Dd in relation to the wagon 6 appropriately.

This configuration is advantageous, as it is fixed and stationary in relation to wagon 6, and is therefore not subject to the vibrations and movements of the measured wagon 6.

In addition, the proposed system 1 is configured to group data from the set of sensors 5 and store them in a storage center. This process can also be called clustering and allows categorizing and analyzing the data obtained by the set of sensors 5, also composing a maintenance history of the wagon 6 and its identification.

The present invention also refers to a method for detecting wagon swing 6 compatible with the system 1 already described. Thus, for all purposes, the characteristics of this system 1 apply, mutatis mutandis, also to said method and will not be detailed again below.

In any case, the proposed method is implemented using a set of fixed sensors 5, spaced apart, arranged at a height H1 from the ground and installed on a section of a railway track 2.

In order for the method to be implemented as claimed and the objectives of the present invention to be achieved, it is necessary to carry out an initial installation step.

More specifically, the proposed method may include an initial step of assembling the set of sensors 5 in a region of the railway track away from the tracks, which is carried out immediately after a section where swing is produced.

Therefore, this means that, in line with what has already been described, the set of sensors 5 is mounted (installed) in a region distant from the tracks and not on, coupled to or tangent to them (see FIG. 8).

After the initial step, there is a step of this method that comprises sequentially activating each sensor 5*a*, 5*b*, 5*c*, 5*d* of the set of sensors 5 through the passage of the wagon 6, as exemplified in sequential FIGS. 2 to 6. In one configuration, this activation is automatic and, as already mentioned, each of said sensors 5*a*, 5*b*, 5*c*, 5*d* is configured to perform the measurement after the measurement of the immediately previous sensor.

Thus, a step of the proposed method is to measure a distance Da, Db, Dc, Dd through each sensor 5*a*, 5*b*, 5*c*, 5*d* respectively, so that each distance is measured sequentially and configured as a reference parameter for the subsequent distance.

In other words, sensor 5*a* will measure the distance Da and then sensor 5*b* will measure the distance Db, followed by sensor 5*c* which will measure the distance Dc and finally the sensor 5*d* will measure the distance Dd. Obviously, the number of sensors and consequently of measured quantities is not a limitation of the invention, so that this step can comprise as many measurements as necessary, made by additional sensors configured with the teachings of the present invention.

In line with what has already been described, it is important to highlight that in accordance with the teachings of the present invention and moving away from the solutions known in the state of the art, the invention proposed here can be carried out disregarding an angle of attack of the wagon wheels 6 measured between an axis of such wheels and a horizontal plane on which railway tracks are located, as illustrated in FIGS. 9 and 10.

This feature is quite advantageous, as it makes the present invention possible to verify the real swing of the wagon 6, which does not occur when considering the angle of attack.

It is also a step in the proposed method to also obtain at least one damping curve related to the rocking of wagon 6. Such damping curve can be one of those exemplified in FIG. 7, and can be obtained after wagon 6 passes the last sensor from sensor array 5.

Additionally, the proposed method may comprise an additional step of characterizing conditions of the damping assembly 7.

In more details, this step is configured to characterize the integrity of the damping assembly 7, which can be characterized as good, worn or critical. Having already been explained previously, such characterizations or classifications will not be detailed again, but it should be noted that other classifications can also be implemented without prejudice to the teachings of the present invention.

For example, if an artificial intelligence solution controlled in accordance with the principles of the present invention is implemented, a fuzzy rupture-type logic can be used in accordance with the teachings or proposal, which will allow for the characterization or classification in more detail of the integrity of wagon components 6, such as the damping assembly 7.

Merely as a non-limiting example, such detailed and additional classifications can be completely intact, partially worn, severely worn, extremely critical, without conditions of use, among others.

In any case, and quite beneficially, the present invention makes it possible to determine the real swing of the wagon and relate it to other important characteristics, such as conditions of a damping assembly 7.

Additionally, the suggested method may also include a step of checking at least the frequency, amplitude and damping coefficient related to the rocking of the wagon 6 through its damping curve.

This is because these are important parameters to be monitored and bring valuable information that, upon evaluation by an operator, can indicate necessity of maintenance, replacement of wagons 6, components, among others.

In this regard, the method may also include a step of grouping data from the set of sensors 5 and storing them in a storage center (not shown).

The storage of the data obtained is very relevant to evaluate the history of each observed wagon 6. Thus, the method may also include a step of composing a maintenance history of wagon 6 based on its swing.

In addition, the method may also include a step of identifying wagon 6, which is done through data crossing. More specifically, considering the passage of the train with the wagon 6 through sensor set 5, valuable information about it can be verified in its file. The identification of the wagon 6 can be done as follows: a time of passage of the wagon 6 through the set of sensors 5 is considered. Therefore, based on the gaps between each wagon, the number of wagons 6 is also counted of that train and, comparing this information with the crossing time at that specific point, it is possible to identify such wagon 6.

In line with what has already been described, the method is preferably configured to be able to act on a wagon 6 that has at least one flat side face, to which the set of sensors is directed. This geometry optimizes the measurement of data and information by the set of sensors 5, as already explained.

Obviously, except for some adaptations, the present proposal could also operate on other wagons 6, such as cylindrical ones, for example.

Furthermore, the wagon swing detection method 6 can be carried out at a swing measuring station, being compatible with the wagon swing detection system 1 also object of the present invention.

Furthermore, as shown in FIG. 8, the present invention provides for a swing measuring station comprising a set of fixed sensors 5, spaced apart, arranged at a height H1 from the ground and installed on a section of a railway track 2.

The proposed swing measuring station is compatible with the wagon swing detection system 1 and the wagon swing detection method and, for this reason, its components will not be detailed again.

The proposed station allows to verify at least the frequency, amplitude and damping coefficient related to the rocking of the wagon 6 and characterize conditions of a damping set 7.

To provide adequate and useful operation, said measuring station is ideally mounted immediately after a section where rocking is produced, so that the height H1 is compatible with a height H2 of the wagon 6 as illustrated in FIG. 8.

However, such a station can be set up on any stretch of railway, allowing advantageously to obtain a plurality of information from cars 6 and even from an entire train based on the teachings described herein.

For illustrative purposes only, an example of a possible embodiment of the present invention will be described below.

Example 1

Here, reference parameters obtained from a new wagon 6 are initially considered, that is, with its damping assembly 7 completely intact. From this wagon 6, swing data is extracted, which especially includes frequency, damping factor and respective damping curve.

In principle, the set of sensors 5 consists of four sensors, a quantity that proved to be reasonable to achieve the objectives proposed here, but this quantity is obviously not a limitation of the invention.

In any case, the sensor array 5 is configured to take continuous readings. In one configuration, for example, twenty readings are taken per second to obtain a reasonable damping curve, but this amount can vary without affecting the teachings described here.

When wagon 6 passes through the set of sensors 5, its data is obtained in the form of primary data ("raw"). This data is processed and can be smoothed by processes already known in the prior art, so that noise, also called "outliers", is removed and discarded.

Subsequently, its damping curve can be obtained in accordance with the teachings already described here. One way to obtain this curve is mathematically, using the least squares method.

From there, the curve obtained is compared with the reference parameters, thus being able to characterize (classify) the integrity of the damping assembly of each wagon 6 in accordance with parameters and comparisons already detailed in this text.

Having described a preferred embodiment example, it must be understood that the scope of the present invention covers other possible variations, being limited only by the content of the attached claims, including possible equivalents.

The invention claimed is:

1. A wagon swing detection system (1) comprising a set of fixed sensors (5), spaced apart, arranged at a certain height from the ground (H1) and installed on a section of a railway track (2), wherein each sensor (5*a*, 5*b*, 5*c*, 5*d*) of the set of sensors (5) is configured to measure a respective distance (Da, Db, Dc, Dd) in relation to the wagon (6) so that each distance is measured sequentially and configured as a reference parameter for the subsequent distance, in which a swing of the wagon (6) is obtained based on each distance (Da, Db, Dc, Dd) so as to allow obtaining at least one real damping curve related to said swing of the wagon (6);

wherein the set of sensors (5) is formed by a plurality of sensors (5*a*, 5*b*, 5*c*, 5*d*), each of said sensors (5*a*, 5*b*, 5*c*, 5*d*) being configured to carry out its measurement after a measurement of the immediately previous sensor;

wherein the system is configured in such a way that conditions of a damping assembly (7) are characterized as a function of the actual damping curve related to said wagon swing (6), in which frequency and damping factor information are considered to characterize the conditions of the damping assembly (7); and wherein the conditions of the damping assembly (7) characterize its integrity and can be at least good, normal or bad, in which the classification is based on statistical data for each wagon (6), in which the real damping curve can be compared with a theoretical damping curve which is configured as a reference for said wagon swing characterization (6) and subsequent characterization of integrity of the damping assembly (7), in which the characterization can be done at two levels: a first verification based on absolute values of data for each wagon (6) and a second verification based on rules so that the classification of the wagon (6) is based on a comparison with the theoretical damping curve and possible discrepancies with the real damping curve.

2. The wagon swing detection system (1) in accordance with claim 1, wherein the system is configured so that obtaining the distances (Da, Db, Dc, Dd) can be done disregarding an angle of wheel attack of the wagon (6) measured between an axis of such wheels and a horizontal plane on which railway tracks are located.

3. The wagon swing detection system (1) in accordance with claim 2, wherein the system is configured to be able to act on a wagon (6) that has at least one flat side face.

4. The wagon swing detection system (1) in accordance with claim 3, wherein the system is mounted in a region of the railway track away from the tracks, in order to allow the sensors (5*a*, 5*b*, 5*c*, 5*d*) of the set of sensors (5) measure the respective distances (Da, Db, Dc, Dd) in relation to the wagon (6).

5. The wagon swing detection system (1) in accordance with claim 4, wherein the system is fixed in relation to the wagon (6).

6. The wagon swing detection system (1) in accordance with claim 5, wherein the damping curve related to the swing of the wagon (6) can be completely obtained after the wagon (6) passes by the last sensor of the set of sensors (5), wherein the damping curve allows checking at least the frequency, amplitude and damping coefficient related to the movement of the wagon (6).

7. The wagon swing detection system (1) in accordance with claim 6, wherein the system is configured to group data from the set of sensors (5) and store them in a storage center.

8. The wagon swing detection system (1) in accordance with claim 7, wherein the system allows composing a maintenance history of the wagon (6) as a function of its swing.

9. The wagon swing detection system (1) in accordance with claim 8, wherein the system allows the wagon (6) to be identified.

10. The wagon swing detection system (1) in accordance with claim 9, wherein the height (H1) is compatible with a wagon height (H2).

11. The wagon swing detection system (1) in accordance with claim 10, wherein the system is mounted immediately after a point where swing is produced (8).

12. The wagon swing detection system (1) in accordance with claim 11, wherein the system comprises a swing measurement station.

13. A wagon swing detection method implemented using a set of fixed sensors (5), spaced apart, arranged at a height (H1) from the ground and installed on a section of a railway track (2), the method comprising at least the steps of:

sequentially activating each sensor (5*a*, 5*b*, 5*c*, 5*d*) of the set of fixed sensors (5) through passage of a wagon (6);

measuring a distance (Da, Db, Dc, Dd) in relation to the wagon (6) using each sensor (5*a*, 5*b*, 5*c*, 5*d*) respectively, so that each distance is measured sequentially and configured as a reference parameter for the subsequent distance;

obtaining at least one damping curve related to swing of the wagon (6);

wherein each of said sensors (5*a*, 5*b*, 5*c*, 5*d*) is configured to perform measurement after measurement of the immediately preceding sensor;

wherein the method further comprises an additional step of characterizing conditions of a damping assembly (7) as a function of each distance (Da, Db, Dc, Dd);

wherein the step of characterizing conditions of the damping assembly (7) is configured so as to characterize integrity of the damping assembly (7) as at least good, normal or bad, in which the classification is based on statistical data for each wagon (6), in which the actual damping curve can be compared with a theoretical damping curve which is configured as reference for said characterization of the wagon swing and subsequent characterization of the integrity of the damping assembly (7), in which the characterization step can be done at two levels: a first verification based on absolute values of the data for each wagon (6) and a second verification based on rules so that the wagon classification is based on a comparison with the theoretical damping curve and possible discrepancies with the real curve.

14. The wagon swing detection method in accordance with claim 13, wherein the method can be carried out disregarding an angle of attack of the wagon wheels (6)

measured between an axis of such wheels and a horizontal plane on which railway tracks lie.

15. The wagon swing detection method (6) in accordance with claim 14, wherein the method is configured to be able to act on a wagon (6) that has at least one flat side face.

16. The wagon swing detection method (6) in accordance with claim 15, wherein the method further comprises an initial step of mounting the set of sensors (5) in a region of the railway track away from the tracks.

17. The wagon swing detection method in accordance with claim 16, wherein the step of also obtaining at least the damping curve related to the swing of the wagon (6) can be carried out after the wagon (6) passes through the last sensor of the sensor set (5).

18. The wagon swing detection method in accordance with claim 17, further comprising a step of checking at least frequency, amplitude and damping coefficient related to the swing of the wagon (6) by middle of its damping curve.

19. The wagon swing detection method in accordance with claim 18, further comprising a step of grouping data from the set of sensors (5) and storing them in a storage center.

20. The wagon swing detection method in accordance with claim 19, further comprising a step of composing a maintenance history of the wagon (6) depending on its swing.

21. The wagon swing detection method in accordance with claim 20, further comprising a step of identifying the wagon (6).

22. The wagon swing detection method in accordance with claim 21, wherein the initial assembly step is carried out immediately after a section where swing is produced.

23. The wagon swing detection method in accordance with claim 22, wherein the method is carried out at a swing measuring station.

24. A swing measuring station comprising a set of fixed sensors (5), spaced apart, arranged at a height (H1) from the ground and installed on a section of a railway track (2), wherein each sensor (5*a*, 5*b*, 5*c*, 5*d*) of the set of sensors (5) is mounted in a region of the railway track away from the tracks and configured to measure a respective distance (Da, Db, Dc, Dd) in relation to the wagon (6), so that each distance is measured sequentially and configured as a reference parameter for the subsequent distance, so as to also allow obtaining at least one real damping curve related to the swing of the wagon (6), allowing to verify at least the frequency, amplitude and damping coefficient related to the movement of the wagon (6) and characterize conditions of a damping assembly (7) regarding its integrity, which can be characterized as at least good, normal or bad, wherein the actual damping curve can be compared with a theoretical damping curve which is configured as a reference for said characterization of the wagon swing (6) and subsequent characterization of the integrity of the damping assembly (7), in which the characterization can be done at two levels: a first verification based on absolute values of the data for each wagon (6) and a second verification based on rules so that the classification of the wagon is based on a comparison with the theoretical damping curve and possible discrepancies with the real damping curve, in which an angle of attack of the wagon wheels (6) measured between an axis of such wheels and a horizontal plane in which they lie railway tracks, which can be completely obtained after the wagon (6) passes the last sensor of the set of sensors (5), in which the wagon (6) has at least one flat side face and can be identified, in which data from the set of sensors (5) are grouped and stored in a storage center, allowing the creation of a maintenance history of the wagon (6) depending on its swing, in which said measuring station is mounted immediately after a section where rocking is produced, so that the height (H1) is compatible with a height (H2) of the wagon (6).

* * * * *